US005674673A

United States Patent [19]

Roussilhe et al.

[11] Patent Number: 5,674,673

[45] Date of Patent: Oct. 7, 1997

[54] SILVER HALIDE COLOR PHOTOGRAPHIC MATERIAL

[75] Inventors: Jacques Roussilhe, Virey Le Grand, France; John Martin Higgins, Middx, United Kingdom

[73] Assignee: Eastman Kodak Company, Rochester, N.Y.

[21] Appl. No.: 515,662

[22] Filed: Aug. 16, 1995

[30] Foreign Application Priority Data

Aug. 17, 1994 [FR] France ..... 94 10229
Aug. 17, 1994 [GB] United Kingdom ..... 94 16590

[51] Int. Cl.[6] ..... G03C 1/06; G03C 7/26; G03C 7/32

[52] U.S. Cl. ..... 430/544; 430/505; 430/529; 430/533; 430/602; 430/603; 430/605; 430/607; 430/609; 430/611; 430/627; 430/629; 430/957; 430/382

[58] Field of Search ..... 430/505, 543, 430/544, 567, 607, 609, 611, 627, 629, 957, 529, 602, 603, 605, 382, 533

[56] References Cited

U.S. PATENT DOCUMENTS

| | | | |
|---|---|---|---|
| 3,046,132 | 7/1962 | Minsk | 430/605 |
| 3,813,247 | 5/1974 | Minsk et al. | 430/627 |
| 3,860,428 | 1/1975 | Ponticello et al. | 430/629 |
| 4,013,471 | 3/1977 | Pollet et al. | 430/629 |
| 4,072,526 | 2/1978 | Sels et al. | 430/629 |
| 4,294,920 | 10/1981 | Helling et al. | 430/629 |
| 5,041,367 | 8/1991 | Sniadoch | 430/629 |
| 5,439,785 | 8/1995 | Boston et al. | 430/629 |
| 5,529,893 | 6/1996 | Vaisecchi et al. | 430/529 |
| 5,569,576 | 10/1996 | Dewanckele et al. | 430/629 |

FOREIGN PATENT DOCUMENTS

| | | |
|---|---|---|
| 2008905 | 1/1970 | France . |

*Primary Examiner*—Geraldine Letscher
*Attorney, Agent, or Firm*—Peter C. Cody; Sarah Meeks Roberts

[57] ABSTRACT

The invention concerns a color negative process wherein a photographic material comprising silver chloride or silver bromide and a DIR or DIAR coupler is processed in the presence of a polyester comprising intralinear thioether atoms.

12 Claims, 4 Drawing Sheets

3.0
2.5
2.0
1.5
GAMMA
1.0
0.5
0.0
0
1
2
3
4
5
6
TIME OF DEVELOPMENT / MINUTES
0g/m2 DI(A)R
0.038g/m2 DI(A)R
0.075g/m2 DI(A)R 3.0
2.5
2.0
1.5
GAMMA
1.0
0.5
0
0
1
2
3
4
5
6
TIME OF DEVELOPMENT / MINUTES
0g / m2 DI(A)R
0.038g / m2 DI(A)R
0.075g / m2 DI(A)R 3.0
2.5
2.0
1.5
GAMMA
1.0
0.5
0
0
1
2
3
4
5
6
TIME OF DEVELOPMENT / MINUTES
0g / m2 DI(A)R
0.038g/m2 DI(A)R
0.075g/m2 DI(A)R

0g/m2 DI(A)R
0.038g/m2 DI(A)R
0.075g/m2 DI(A)R
GAMMA
3.0
2.5
2.0
1.5
1.0
0.5
0.0
0
1
2
3
4
5
6
TIME OF DEVELOPMENT / MINUTES

0g/m2 DI(A)R
0.038g/m2 DI(A)R
0.075g/m2 DI(A)R
GAMMA
3.0
2.5
2.0
1.5
1.0
0.5
0
0
1
2
3
4
5
6
TIME OF DEVELOPMENT / MINUTES

0g/m2 DI(A)R
0.038g/m2 DI(A)R
0.075g/m2 DI(A)R
GAMMA
3.0
2.5
2.0
1.5
1.0
0.5
0
0
1
2
3
4
5
6
TIME OF DEVELOPMENT / MINUTES 150
146
142
138
134
130
INERT SENSIBILITY
.02
.06
.10
.14
.18
.22
.28
D min
1A
1B
1C 162
158
154
150
146
142
138
134
130
INERT SENSIBILITY
.02
.08
.10
.14
.18
.22
.26
D min
2A
2B
2C 150
146
142
138
134
130
INERT SENSIBILITY
3A
3B
3C
.02
.06
.10
.14
.18
.22
.28
D min 162
158
154
150
146
142
138
134
130
INERT SENSIBILITY
4A
4B
4C
.02
.06
.10
.14
.18
.22
.26
D min

SILVER HALIDE COLOR PHOTOGRAPHIC MATERIAL

FIELD OF THE INVENTION

This invention relates to color photography. In a particular aspect, it relates to the production of color images having improved color correction contrast, granularity and acutance qualities.

BACKGROUND OF THE INVENTION

Development inhibitor releasing (DIR) compounds are used in the color negative processing of silver halide materials. In the color negative process, photographic elements containing DIR compounds can provide improved contrast, granularity, acutance and desirable interlayer interimage effects, without loss of desirable photographic properties.

Various compounds, particularly couplers, are known in the photographic art that are capable of releasing a development inhibitor moiety, such a nitrogen-containing heterocyclic moiety having a mercapto substituent, e.g., a mercaptotetrazole moiety. Such couplers, upon chromogenic development, release a development inhibitor moiety. These couplers are designated as DIR or DIAR couplers. DIR and DIAR couplers are relatively difficult and expensive to synthesize. It is therefore a concern to increase their effectiveness in order to obtain the optimum inhibition effect with the smallest amount of DIR or DIAR compound. Also, the photographic emulsions which are widely used in color negative systems along with DIR or DIAR compounds, are most often silver bromoiodide emulsions. While DIR or DIAR compounds provide advantageous image properties with silver bromoiodide emulsions, problems have been encountered when using them with bromide or chloride emulsions. One such problem is that proper development inhibition without side-effects is much more difficult to achieve for silver bromide or chloride emulsions than for the silver bromoiodide emulsions. This makes the application of such bromide or chloride emulsions in color negative systems more difficult and, although bromide or chloride emulsions are considered advantageous because for example they have superior developability, superior fixing characteristics and none of the problems associated with the presence of iodide, bromoiodide emulsions are generally used in color negative systems. It is the purpose of the present invention to overcome the above-mentioned problems by performing the chromogenic development of a color negative silver halide emulsion in the presence of polyester compounds containing sulfur atoms.

SUMMARY OF THE INVENTION

According to the present invention there is provided a process of forming a color negative image, using a photographic material comprising, (i) a support having thereon at least one silver halide radiation-sensitive emulsion layer containing silver bromide or chloride, (ii) a dye image-forming coupler, and (iii) a compound capable of releasing a development inhibitor upon exposure and color development in the presence of a primary amino aromatic developing agent, said process being characterizing in that the color development is performed in the presence of a linear polyester of a dicarboxylic acid polyester containing intralinear thioether heteroatoms.

DETAILED DESCRIPTION OF THE INVENTION

Figure 1A:
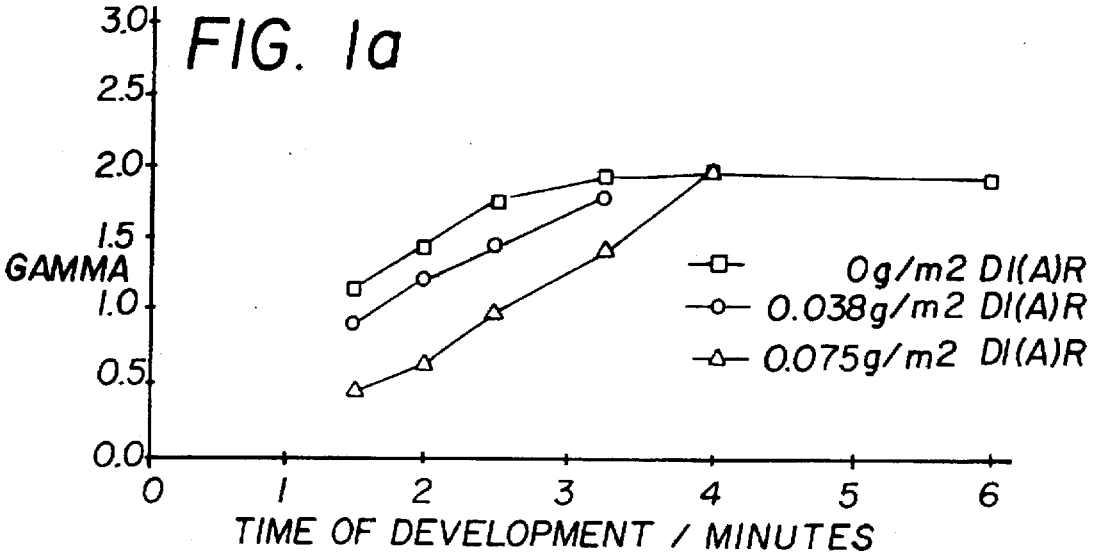
FIG. 1*a*–1*c* show the change in contrast as a function of time of development in silver bromide photographic materials containing varying levels of a DIAR coupler and poly(thiadiethylene glutarate).

According to one embodiment of the invention, the polyester has the formula:

$$\{OCO[(R-S)_{m-1}R^1]_{n-1}COO\ (R^2-S)_{p-1}R^3\}_{r-1}$$

Wherein R, $R^1$, $R^2$, $R^3$ each represent independently an alkylene group containing from about 1 to 10 carbon atoms, m and p each represent a number from 1 to 4, provided m and p do not represent simultaneously 1, r is at least 2, and n is 1 or 2, provided n and p do not represent simultaneously 1, said polyester having a molecular weight of at least 350; preferably, for bromide emulsions, the molecular weight is in the range of 1000–10,000 and most preferably, in the range of 1060–5000 and, for chloride emulsions, in the range of 4000–8000.

Examples of such polyesters are linear polyesters of thia-alkanediols and carboxylic acids such as succinic acid, glutaric acid, adipic acid etc. Compounds illustrative of this class are poly(thiaethylene glutarate), poly(thiadiethylene glutarate), or poly(thiaethylene hexanoate). According to a preferred embodiment, the polyester is the result of the condensation of glutaric acid on the thiaalkanediol, e.g., poly(thiaethylene glutarate). Compounds of this type are described in U.S. Pat. Nos. 3,046,132 and 3,813,247, which are incorporated herein by reference.

The above defined polyesters have to be present during the color development; they can be incorporated into the photographic material, in an emulsion layer or in an auxiliary layer. In the latter case, the amount of polyester, associated with a bromide emulsion, is in the range of 0.0025 g/m$^2$–0.2000 g/m$^2$ and preferably, in the range of from 0.010 to 0.050 g/m$^2$. When associated with a chloride emulsion, the amount of polyester incorporated in the photographic material is in the range of from 100 to 10,000 mg and preferably of from 1000 to 5000 mg per silver mole.

The inhibitors releasing couplers which can be used according to the present invention are those described in Belgian Patent 789,595 and in U.S. Pat. Nos. 3,227,554, 3,379,529, 3,384,657, 3,615,506, 3,617,291 or 3,620,746, which are incorporated herein by reference.

European Patent Applications 169,458 and 272,573 describe photographic elements comprising monocyclic triazole compounds which can be used as inhibitor moieties capable of being used in the present invention; these photographic elements are intended for color negative systems and are reported as exhibiting large interimage effects. Other couplers known in the art are capable of releasing a photographically useful group such as a development inhibitor, by means of an intra molecular nucleophilic displacement reaction (DIAR couplers). These compounds are for instance described in U.S. Pat. Nos. 4,248,962, 4,409,323, and 5,135,839, which are incorporated herein by reference.

The DIAR couplers can be represented by the formula:

*COUP–TIME–INH* where COUP is a coupler moiety which can react with oxidized color developing agent to release the TIME–INH moiety; –TIME is a timing group; and INH is a development inhibitor moiety. COUP includes coupler moieties employed in conventional color-forming couplers or coupler moieties which yield colorless products. The coupler moiety can be unballasted or ballasted with a oil-soluble or fat-tail group.

The –TIME–INH moiety is joined to the coupler moiety at any of the positions from which groups released by reaction with an oxidized color developing agent can be attached. Preferably, the –TIME–INH is attached to the coupling position of COUP.

–TIME can be any organic group which serves to connect COUP to INH and which, after the cleavage of –TIME–INH, will cleave from INH by an intramolecular nucleophilic displacement reaction.

The terms "intramolecular nucleophilic displacement reaction" are understood to refer to a reaction in which a nucleophilic center of a compound reacts at another site on the compound which is an electrophilic center, to effect displacement of a group or atom attached to this electrophilic center. Such reactions are described for instance in Capon and McManus, Neighbouring Group Participation, vol. 1. Plenum Press, New-York, 1976.

INH is a development inhibitor moiety which is released from –TIME as a result of the above-mentioned displacement mechanism. Development inhibitor moieties are described in representative references such as U.S. Pat. Nos. 3,227,554; 3,384,657; 3,615,506; 3,617,291. Preferred development inhibitors are iodide and heterocyclic compounds such as mercaptotetrazoles, selenotetrazoles, mercaptobenzothiazoles, mercaptobenzoxazoles, mercaptobenzimidazoles, benzotriazoles, benzodiazoles.

The emulsions may be prepared using various techniques, for example single-jet, double-jet or accelerated-flow precipitation techniques as described by Trivelli and Smith, *The Photographic Journal,* Vol. LXXIX, May 1939, pages 330–338, by T. H. James, *The theory of the Photographic Process,* 4th Edition, Macmillan, 1977, Chapter 3, by Niertz et al in U.S. Pat. No. 2,222,264, by Wilgus in the German Patent Application No 2,107,118, by Lewis in U.S. Pat. Nos. 1,335,925, 1,430,465 and 1,469,480, by Irie et al in U.S. Pat. No. 3,650,757, by Morgan in U.S. Pat. No. 3,917,485, by Musliner in U.S. Pat. No. 3,979,213 and in *Research Disclosure,* September 1994, paragraph 1C, all of which are incorporated herein by reference. Research Disclosure is a publication of Industrial Opportunities Ltd, Homewell, Hayant, Hampshire, P09 1EF, United Kingdom.

The silver halide grains of the emulsions according to the invention can have the crystalline habits Generally used in silver halide photography, as described in "Photographic silver hamide emulsions preparations, addenda, systems and processing" Research Disclosure, September 1994/501, paragraph 1B. The Grains consist of silver bromide or chloride, possibly associated with silver bromoiodide, silver chloroiodide or mixtures of these e.g., in the form of blends. When the Grains contain iodide, the maximum possible quantity of iodide is the quantity which can be accepted by the crystal lattice.

Modifying compounds may be present during the precipitation of the Grains. Such compounds may be present in the reaction vessel initially or they may be added at the same time as one or more salts, in accordance with conventional operating methods. The modifying compounds, such as the middle chalcogens (namely sulfur, selenium and tellurium), gold and the noble Group VIII metals (for example iridium), may be present during the precipitation of the halides, as described in Research Disclosure; September 1994, paragraph 1D.

The emulsions obtained according to the invention are intended for negative working processes. The color materials generally comprise a support covered with at least one layer of-silver halide emulsion with which are associated one or more dye-forming couplers.

These emulsions can be chemically sensitized by any conventional technique or using any conventional sensitizer, such as those indicated in Research Disclosure No 501, September 1994, paragraph IV. These sensitizers comprise, for example, active gelatin, as described by T H James, *The Theory of the photographic Process,* 4th Edition, Macmillan; 1977, pages 67–76, or sulfur, selenium, tellurium, gold, platinum, palladium, iridium, osmium, rhodium, rhenium or phosphorus sensitizers or combinations of these sensitizers, at pAg values between 5 and 10, pH levels between 5 and 8 and temperatures between 30° and 80° C., as described in Research Disclosure, Vol. 120, April 1974, Article 12008, *Research Disclosure,* Vol. 134, June 1975, Article 13452, by Sheppard et al in U.S. Pat. No. 1,623,499, by Matthies et al in U.S. Pat. No. 1,673,522, by Waller et al in U.S. Pat. No. 2,339,083, by Damschroder et al in U.S. Pat. No. 2,642,361, by McVeigh in U.S. Pat. No. 3,297,447, by Dunn in U.S. Pat. No. 3,297,446, by McBride in UK Patent 1,315,755, by Berry et al in U.S. Pat. No. 3,772,031, by Gilman et al in U.S. Pat. No. 3,761,267, by Ohi et al in U.S. Pat. No. 3,857,711, by Klinger et al in U.S. Pat. No. 3,565,633, by Oftedahl in U.S. Pat. Nos. 4,901,714 and 3,904,415 and by Simons in UK Patent 1,396,696, all of which are incorporated herein by reference; the chemical sensitization may optionally be effected in the presence of thiocyanates, preferably at concentrations between $2\times10^{-3}$ and 2% molar with respect to the total silver content, as described by Damschroder in U.S. Pat. No. 2,642,361; sulfur-containing compounds of the type described in the U.S. Pat. Nos. 2,521,926 of Lowe et al, 3,021,215 of Williams et al and 4,054,457 of Bigelow. Specifically, it is considered that chemical sensitization can be effected in the presence of compounds which modify chemical sensitization, that is to say compounds known to eliminate fogging and increase sensitivity when they are present during chemical sensitization, such as the azaindenes, azapyridazines, azapyrimidines and salts of benzothiazolium, and sensitizers comprising one or more heterocyclic rings. Examples of finishing modifiers are described in the U.S. Pat. Nos. 2,131,038 of Brooker et al, 3,411,914 of Dostes, 3,554,757 of Kuwabara et al, 3,565,631 of Oguchi et al and 3,901,714 of Oftedahl, in the Canadian Patent 778,723 of Walworth and in Duffin, *Photographic Emulsion Chemistry,* Focal Press (1966), New York, pages 138–143. In addition, the emulsions may be sensitized by reduction—for example, with hydrogen, as described by Janusonis in U.S. Pat. No. 3,891,446 and by Babcock et al in U.S. Pat. No. 3,984,249, by a process using a low pAg (for example below 5) and/or a high pH (for example above 8) or by using reducing agents, such as stannous chloride, thiourea dioxide, polyamines and amine boranes, as described by Allen et al in U.S. Pat. No. 2,983,609, Oftedahl et al in *Research Disclosure,* Vol. 136, August 1975, Article 13654, by Lowe et al in U.S. Pat. Nos. 2,518,698 and 2,739,060, by Roberts et al in U.S. Pat. Nos. 2,743,182 and 2,734,183, by Chambers et al in U.S. Pat. No. 3,026,203 and by Bigelow et al in U.S. Pat. No. 3,361,564, all of which are incorporated herein by reference. The chemical sensitization may be on the surface or in the interior of the grains as described by Morgan in U.S. Pat. No. 3,917,485 and by Becker in U.S. Pat. No. 3,966,476.

In addition to being sensitized chemically, the silver halide emulsions of the present invention are also sensitized spectrally by means of spectral sensitizing dyes of the methine class such as cyanine or merocyanine dyes. It is considered specifically that spectral sensitizing dyes can be used which have maximum absorption levels in the blue and minus blue portions, i.e. Green and red in the visible spectrum. In addition, in specialized applications, spectral sensitizing dyes which improve the spectral response beyond the visible spectrum can be used.

One or more spectral sensitizing dyes can be used. Dyes are known which have maximum sensitization at various wavelengths in the visible spectrum and a great variety of spectral sensitivity curve forms. The choice and the relative proportions of the dyes depend on the region of the spectrum where it is desired to obtain the sensitivity and on the desired spectral sensitivity curve form. A mixture of sensitizing dyes can be used with partially overlapping absorption spectra; such a mixture can give a spectral sensitivity which, at each wavelength in the overlap, is at least equal to and sometimes greater than the sum of the individual sensitivities of the individual dyes. Mixtures of the dyes specified above can also be used with other conventional sensitizing dyes.

EXAMPLE 1

The following layers were coated onto a poly(ethylene terephthalate) support:

1. Antihalation underlayer

2. Silver bromide emulsion layer comprising tabular grains having a mean grain projected area of 5.2 $\mu m^2$ and an average grain thickness of 0.13 μm, coated at 0.80 $g/m^2$ of silver and 3.0 $g/m^2$ of gelatin. The emulsion layer contained also a cyan dye image forming coupler coated at 1.0 $g/m^2$ and a cyan dye forming DIAR coupler, coated at a laydown of 0.038 or 0.075 $g/m^2$. The emulsion was spectrally sensitized with a red sensitizing dye, hardened with bis-vinylsulfonylmethane and contained 5-carboxy-6-methyltetraazaindene.

Various amounts of poly(thiadlethyleneglutarate) were incorporated in this layer, namely 0.015 or 0.030 $g/m^2$.

The coated materials were exposed for 0.01 seconds using a tungsten bulb with a Wratten 29 filter and a step-wedge and processed using several development times in a standard Kodak C-41 process. The densities (D) of the step wedge image so produced were measured and plotted against the appropriate relative exposure level (log H). Several parameters could be derived from these densitometric results, but in particular the contrast or gamma (that is, the maximum value of the 1st derivative of the H+D curve: dD/dlog(H) within the range $D_{min}$ to $D_{max}$) was calculated.

Figure 1B:
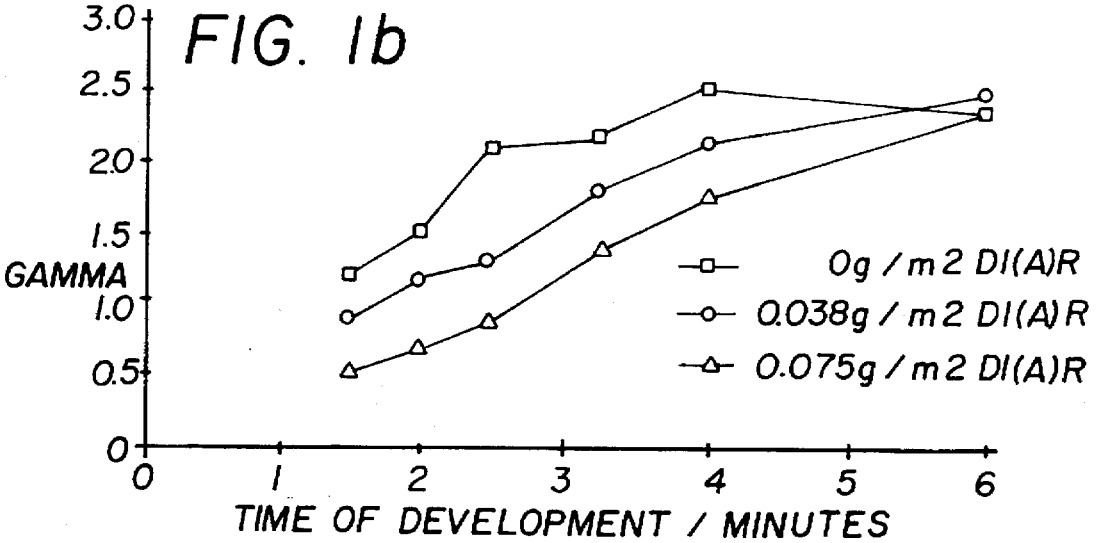
Figure 1C:
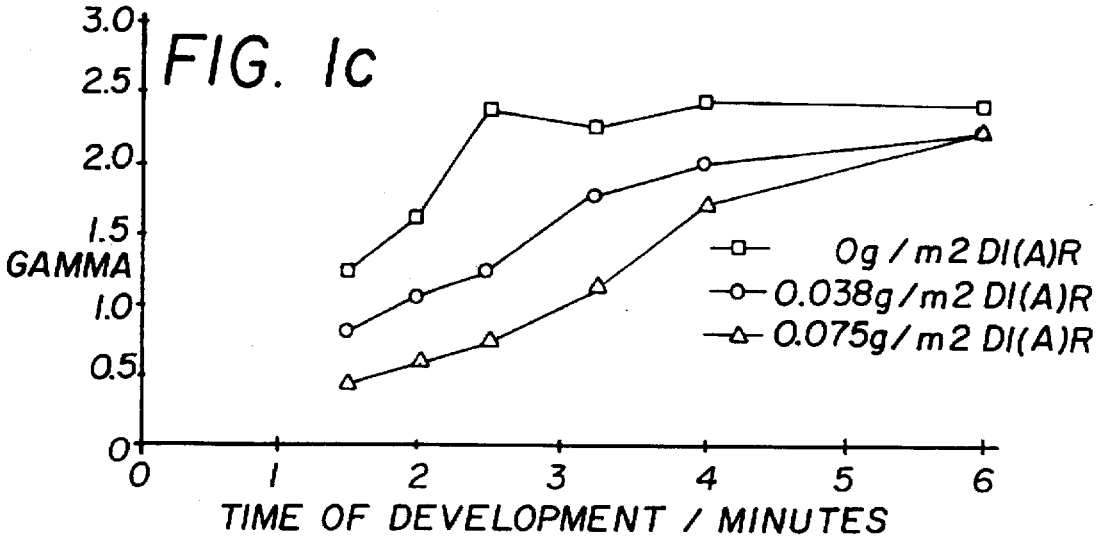

The results obtained are Given in a graphical form in FIG. 1*a,* 1*b,* 1*c* showing the change in gamma, that is, the emulsion contrast, as a function of time of development. The differences between the curves show the amount of change in gamma caused by the DIAR coupler, in the absence of poly(thiodiethylene glutarate) (FIG. 1*a*) and in the presence of 0,015 and 0,030 $g/m^2$ of poly(thiodiethylene glutarate), (FIGS. 1*b*–1*c* respectively).

The curves show the impact of increasing amounts of poly(thiodiethylene glutarate) on the efficiency of a DIAR coupler. The curves also show the accelerating effect of poly(thiodiethylene glutarate) on the bromide emulsions.

EXAMPLE 2

Figure 2A:
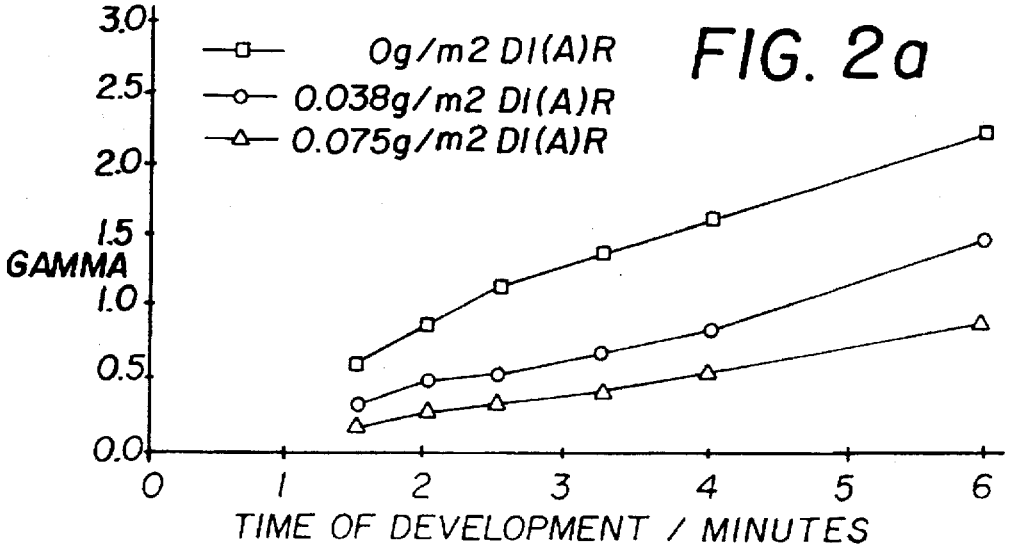
FIG. 2*a*–2*c* show the change in contrast as a function of time of development in silver bromoiodide photographic materials containing varying levels of a DIAR coupler and poly(thiadiethylene glutarate).
Figure 2B:
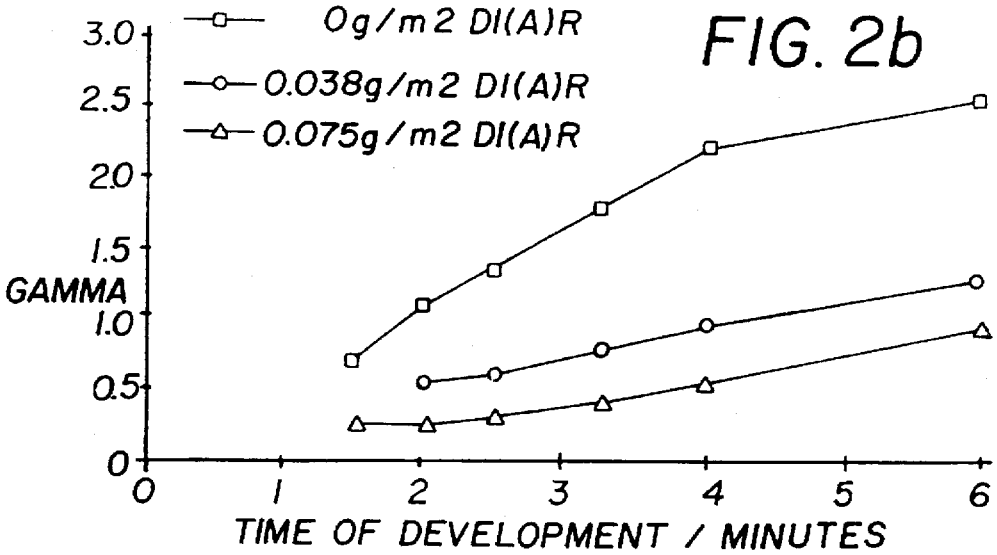
Figure 2C:
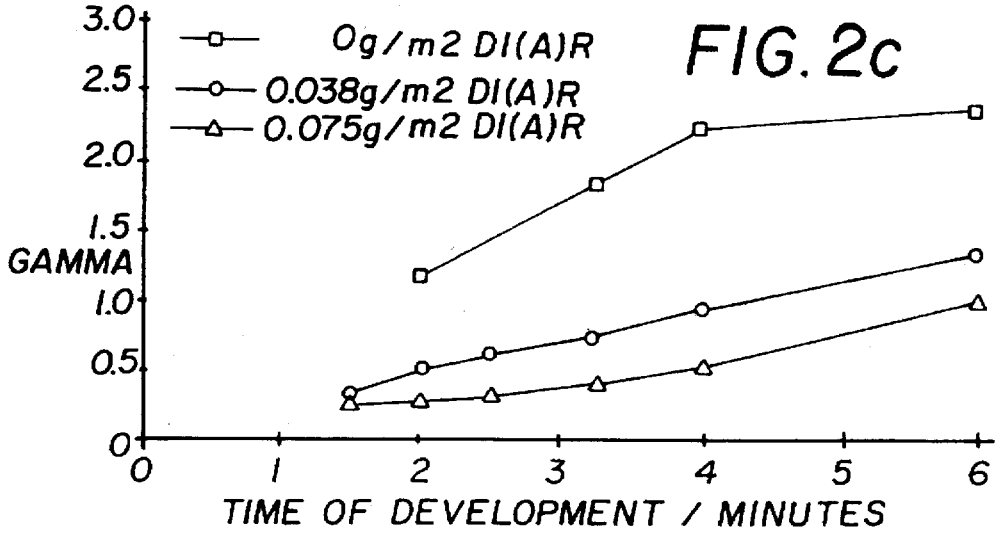

The procedure of Example 1 was repeated, except that silver bromoiodiode emulsions (3 % mole iodide) were substituted for the silver bromide emulsions of Example 1. The results obtained are given in the same graphical form as for Example 1, in FIG. 2*a,* 2*b,* 2*c*. The curves show that the bromoiodide emulsions are more responsive to the DIAR coupler, with or without poly(thiodiethylene glutarate).

The curves show that the bromoiodide emulsions are more responsive to the DIAR coupler with poly (thiodiethylene glutarate). The curves also show that bromoiodide is less responsive to the poly(thiodiethylene glutarate) than bromide emulsions.

EXAMPLE 3

The following layers were applied in this order to a cellulose acetate support.

1. Antihalation layer.

2. Layer of cubic silver chloride emulsion (0.807 g $Ag/m^2$, 3.23 g of gelatin/$m^2$), diameter 0.38 μm, sensitized with gold sulfide and sensitized to the green with the dye of formula A and containing a cyan-forming coupler (Compound I, 1.174 $g/m^2$) and a DIR coupler (Compound II, 1.27 $g/m^2$).

3. Top layer 2.15 g of gelatin/$m^2$ plus a surfactant.

Different quantities of polythiadiethylene glutarate were incorporated in different samples of this product in the layer of emulsion, in accordance with the information set out in Table 3. Polythiaethylene glutarate, known by the name Lanothane, is a compound with a relative molecular weight of 4000–8000.

The samples were each exposed for 0.10 seconds to a 5500K tungsten source, interposing a Wratten No 9 filter, and then processed using the conventional Kodak C-41 process.

Figure 3:
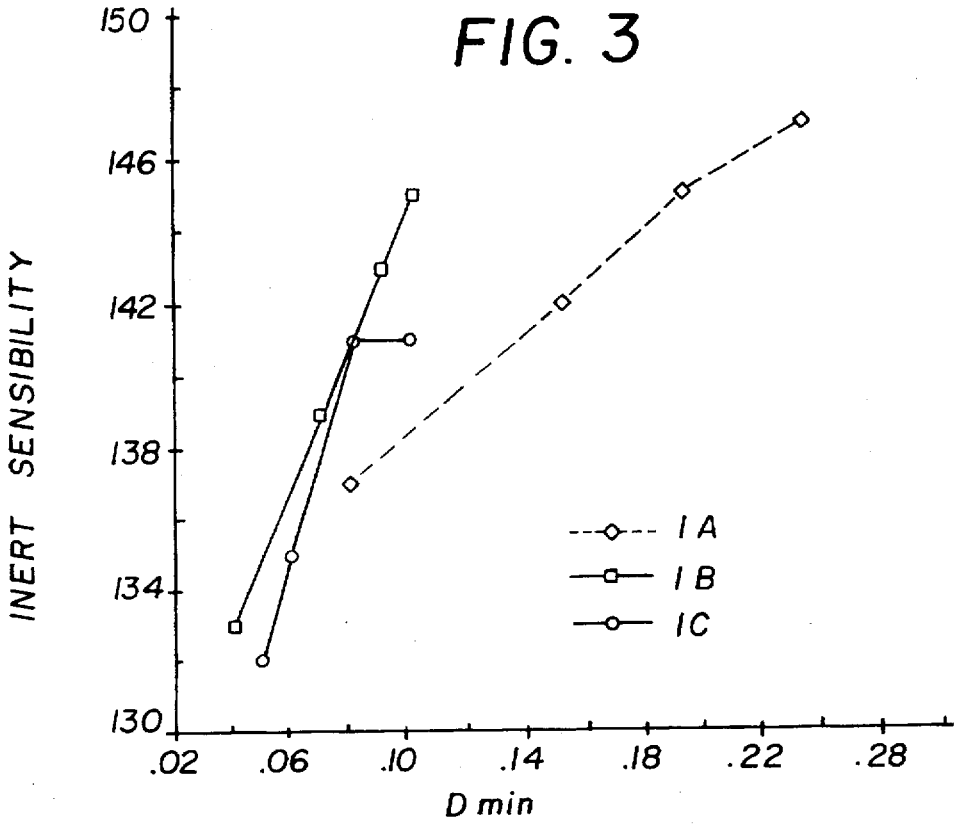
FIG. 3 shows the variation in sensitivity as a function of minimum density, for different development times, in silver chloride photographic materials containing a DIR coupler and varying amounts of poly(thiadiethylene glutarate).

The results obtained are presented in graph form in FIG. 3; these graphs show the variation in sensitivity as a function of Dmin, for different development times, namely 1 minute 5 seconds, 2 minutes 30 seconds, 3 minutes 15 seconds and 4 minutes. The Lanothane enables the Dmin to be reduced without significant reduction in sensitivity.

The sensitivity noted in this paragraph is the INERT (inertial) sensitivity, which corresponds to the intersection of the H & D layer and the line parallel to the axis of the log H values for D=Dmin.

TABLE 3

| Sample | Lanothane ($mg/dm^2$) |
|---|---|
| 1A | 0 |
| 1B | 0.15 |
| 1C | 0.30 |

Coupler I

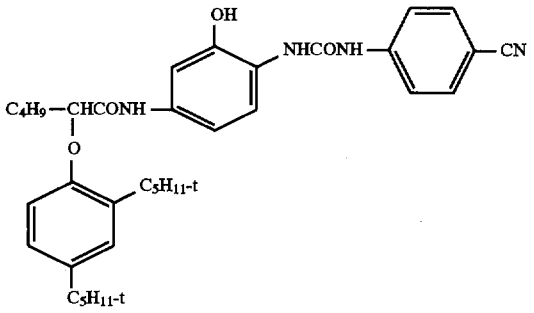

Coupler II (DIR)

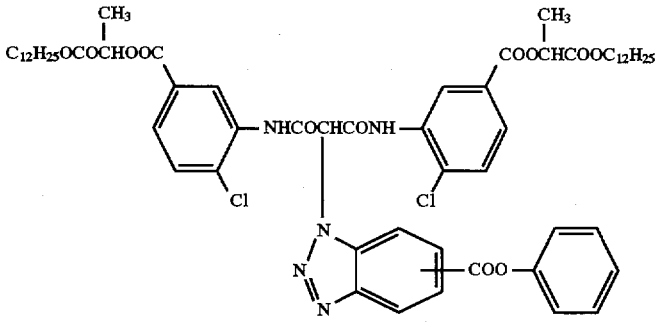

Dye A:

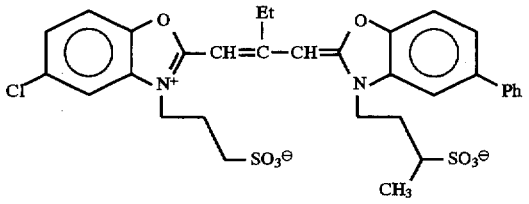

EXAMPLE 4

The operating method of Example 3 was repeated, except that the quantity of DIR coupler this time was 0.1 mg/dm$^2$.

The quantities of Lanothane in each sample were as follows (mg/dm$^2$):

TABLE 4

| Sample | Lanothane (mg/dm$^2$) |
|---|---|
| 2A | 0 |
| 2B | 0.15 |
| 2C | 0.30 |

Figure 4:
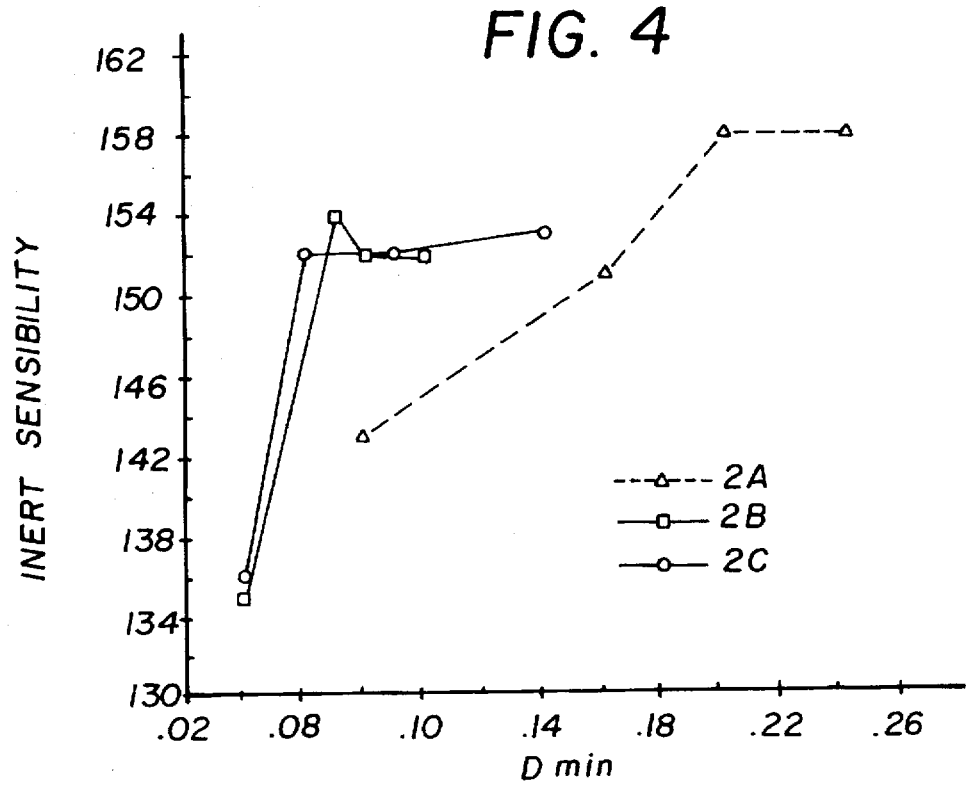
FIG. 4, 5 and 6 show the variation in sensitivity as a function of minimum density, for different development times, in silver chloride photographic materials containing a DIR coupler and varying amounts of poly(thiaethylene gluterate).

The results are presented in graph form in FIG. 4. A reduction in Dmin is likewise obtained, without any significant loss of sensitivity.

EXAMPLE 5

The operating method of Example 3 was repeated, but this time Compound III was used as a DIR coupler, at 0.954mg/dm$^2$. The quantities of Lanothane in each sample were as follows:

TABLE 5

| Sample | Lanothane (mg/dm$^2$) |
|---|---|
| 3A | 0 |
| 3B | 0.15 |
| 3C | 0.30 |

Figure 5:
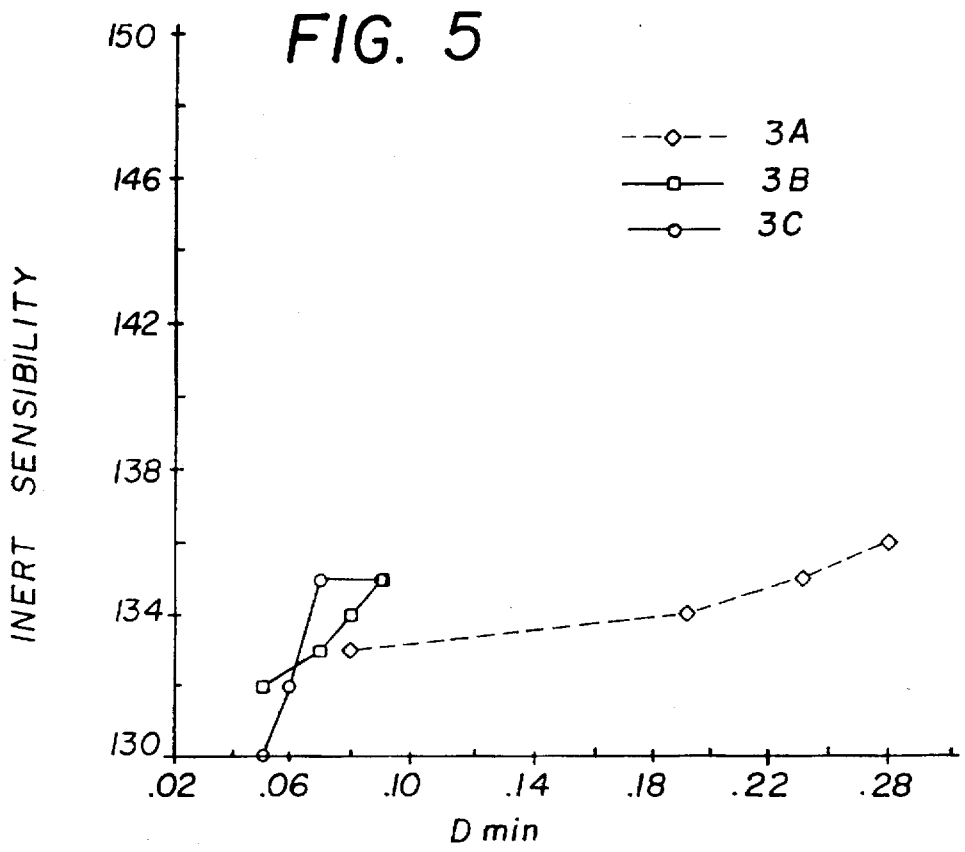

The results are presented in graph form in FIG. 5.

EXAMPLE 6

The operating method of Example 3 was repeated, but Compound III was used as a DIR coupler, at 0.075 mg/dm$^2$. The quantities of Lanothane in each sample were as follows:

TABLE 6

| Sample | Lanothane (mg/dm$^2$) |
|---|---|
| 4A | 0 |
| 4B | 0.15 |
| 4C | 0.30 |

Figure 6:
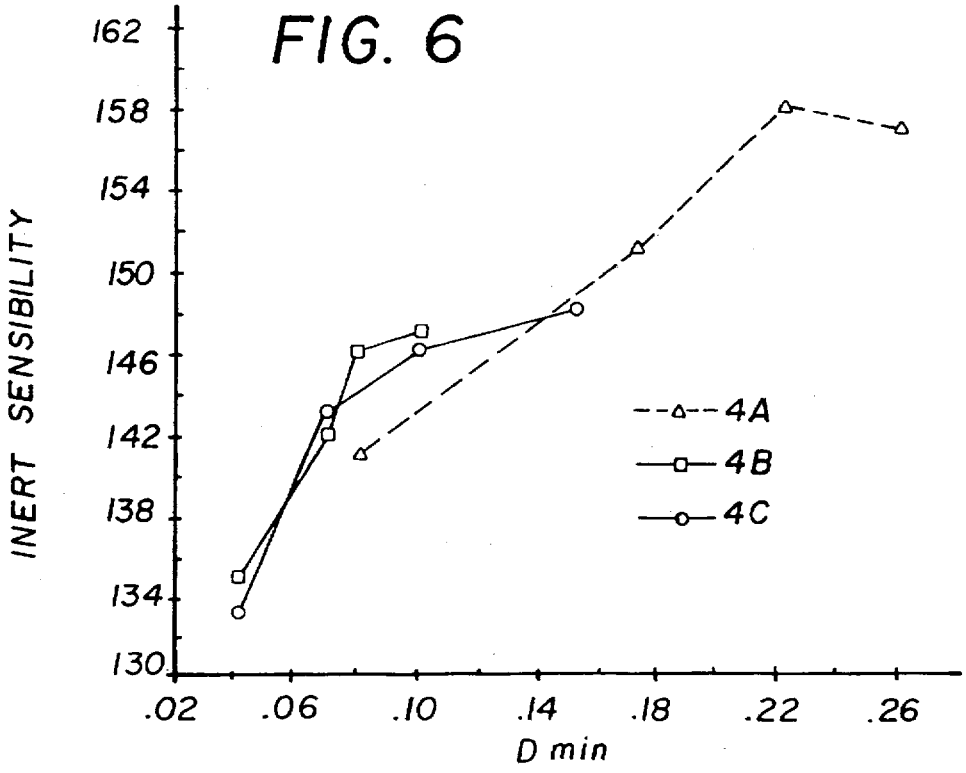

The results are presented in graph form in FIG. 6.

Compound III has the formula:

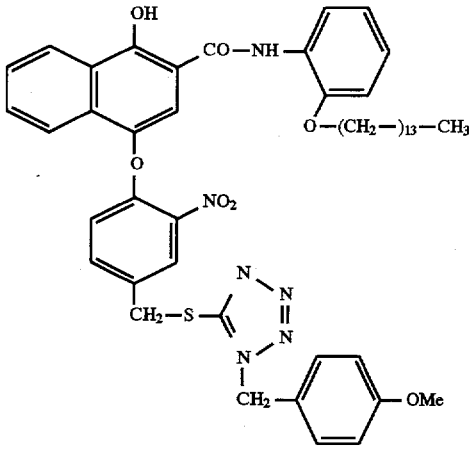

The invention has been described in detail with particular reference to Certain preferred embodiments thereof, but it will be understood that variations and modifications can be effected within the spirit and scope of the invention.

What is claimed is:

1. A process of forming a color negative image comprising the steps of imagewise exposing and color developing a photographic material comprising (i) a support having coated thereon at least one silver halide radiation-sensitive emulsion layer containing silver bromide or silver chloride, (ii) a dye image-forming coupler, and (iii) a coupler capable of releasing a development inhibitor on development with a primary amino color developing agent, wherein said process is performed in the presence of a linear polyester of a dicarboxylic acid which has the formula:

$$\{OCO[(R\text{-}S)_{m-1}R^1]_{n-1}COO(R^2\text{-}S)_{p-1}R^3\}$$

wherein R, $R^1$, $R^2$, $R^3$ each represent independently an alkylene group containing from about 1 to 10 carbon atoms, m and p each represent a number from 1 to 4, provided m and p do not represent simultaneously 1, r is at least 2. and n is 1 or 2, provided n and p do not represent simultaneously 1, said polyester having a molecular weight of at least 350.

2. The process of claim 1, wherein the polyester is a polyester of a dicarboxylic acid which is selected from the group consisting of succinic acid, adipic acid, glutaric acid.

3. The process of claim 1, wherein the polyester is a polyester of thioalkanediol.

4. A photographic material, comprising (i) a support having coated thereon at least one silver halide radiation-sensitive emulsion layer containing silver bromide, or silver chloride, (ii)a dye image-forming coupler and (iii), a coupler capable of releasing a development inhibitor upon exposure and development with a primary amino color developing agent, and a linear polyester of a dicarboxylic acid having the formula:

$$\{OCO[R\text{-}S)_{m-1}R^1]_{n-1}COO(R^2\text{-}S)_{p-1}R^3)_{r-1}$$

wherein R, $R^1$, $R^2$, $R^3$ each represent independently an alkylene group containing from about 1 to 10 carbon atoms, m and p each represent a number from 1 to 4, provided m and p do not simultaneously represent 1, r is at least 2, and n is 1 or 2, provided n and p do not represent simultaneously 1, said polyester having a molecular weight of at least 350.

5. The photographic material of claim 4, wherein the dicarboxylic acid is succinic acid, glutaric acid or adipic acid.

6. The photographic material of claim 4 wherein the polyester is a polyester of a dicarboxylic acid which is glutaric acid.

7. The photographic material of claim 6, wherein the polyester is a polyester of thioalkanediol.

8. The photographic material of claim 4, wherein the compound capable of releasing a development inhibitor moiety has the formula:

*COUP–TIME–INH* where COUP is a coupler moiety; TIME is an organic Group, attached to the coupling position of COUP and which is capable of cleaving from COUP on color development and then of cleaving from INH by an intramolecular nucleophilic displacement reaction; and IRE is a development inhibitor moiety.

9. The photographic material of claim 4, wherein the radiation-sensitive image-forming layer contains silver bromide and silver bromoiodide.

10. The photographic material of claim 9, wherein the polyester is present in an amount in the range of from 0.0025 to 0.2000 g/m$^2$.

11. The photographic material of claim 4, wherein the radiation-sensitive image-forming layer is a cubic silver chloride emulsion.

12. The photographic material of claim 11, wherein the polyester is present at an amount in the range of 100 to 10,000 mg/silver mole.

* * * * *

UNITED STATES PATENT AND TRADEMARK OFFICE

CERTIFICATE OF CORRECTION

PATENT NO. : 5,674,673

DATED : October 7, 1997

INVENTOR(S) : Jacques Roussilhe
John Martin Higgins

It is certified that error appears in the above-identified patent and that said Letters Patent is hereby corrected as shown below:

Claim 8: Column 10, line 36 delete "IRE" and insert -- INH -- in its place and stead

Signed and Sealed this

Twenty-fourth Day of November, 1998

*Attest:*

Bruce Lehman

BRUCE LEHMAN

*Attesting Officer*

*Commissioner of Patents and Trademarks*